US007938091B2

(12) United States Patent
Sagata

(10) Patent No.: US 7,938,091 B2
(45) Date of Patent: May 10, 2011

(54) CAMSHAFT AND CAMSHAFT MANUFACTURING METHOD

(75) Inventor: Munehiro Sagata, Toyoake (JP)

(73) Assignee: Aichi Machine Industry Co., Ltd., Nagoya-shi (JP)

( * ) Notice: Subject to any disclaimer, the term of this patent is extended or adjusted under 35 U.S.C. 154(b) by 325 days.

(21) Appl. No.: 12/268,736

(22) Filed: Nov. 11, 2008

(65) Prior Publication Data

US 2009/0178636 A1 Jul. 16, 2009

(30) Foreign Application Priority Data

Jan. 10, 2008 (JP) ..... 2008-003743

(51) Int. Cl.
*F01L 1/02* (2006.01)

(52) U.S. Cl. ..... 123/90.31; 123/90.44; 123/90.6; 29/888.1

(58) Field of Classification Search ..... 123/90.31, 123/90.44, 90.6, 90.34; 29/888.1
See application file for complete search history.

(56) References Cited

U.S. PATENT DOCUMENTS

| | | | | |
|---|---|---|---|---|
| 4,957,079 | A | 9/1990 | Nakatani et al. | |
| 7,146,956 | B2 * | 12/2006 | Nomura et al. | 123/90.6 |

FOREIGN PATENT DOCUMENTS

| | | | |
|---|---|---|---|
| DE | 3241712 | A1 | 5/1984 |
| DE | 202007011678 | U1 | 10/2007 |
| EP | 1505266 | A2 | 2/2005 |
| FR | 2667112 | A1 | 3/1992 |
| JP | S62-10001 | Y | 3/1987 |
| JP | H06-129213 | A | 5/1994 |
| JP | 07-224611 | A | 8/1995 |
| JP | 2001-082111 | | 3/2001 |

* cited by examiner

*Primary Examiner* — Ching Chang
(74) *Attorney, Agent, or Firm* — Global IP Counselors, LLP

(57) ABSTRACT

A cam lobe of a camshaft has a base circle portion and a lifting lobe portion. A camshaft journal of the camshaft has first and second bearing portions that bear reaction forces from the base circle portion and the lifting lobe portion, respectively. The first bearing portion has an axial width smaller than that of the second bearing portion with at least a portion of an axial end surface of the first bearing portion facing the cam lobe being disposed away from the cam lobe relative to an axial end surface of the second bearing portion. The base circle portion has an axial width smaller than that of the lifting lobe portion with at least a portion of an axial end surface of the base circle portion facing the camshaft journal being disposed away from the camshaft journal relative to an axial end surface of the lifting lobe portion.

10 Claims, 7 Drawing Sheets

3
3a
3a
3a
3a
3a
3a
11
7
72
71
72
72
71
72
71
6
12
12a
12
12a
12a
12a
12a
12
12a
12a
12
12a
12a
12a
12a

CAMSHAFT AND CAMSHAFT MANUFACTURING METHOD

CROSS-REFERENCE TO RELATED APPLICATIONS

This application claims priority to Japanese Patent Application No. 2008-003743, filed on Jan. 10, 2008. The entire disclosure of Japanese Patent Application No. 2008-003743 is hereby incorporated herein by reference.

BACKGROUND OF THE INVENTION

1. Field of the Invention

The present invention relates to a camshaft and a camshaft manufacturing method.

2. Background Information

Japanese Laid-Open Patent Publication No. 2001-82111 discloses a conventional camshaft in which a width of a sliding contact surface of a base circle portion of a cam lobe is smaller than a width of a sliding surface of a nose (lobe) portion of the cam lobe. With this conventional camshaft, a side surface of the base circle portion (where a surface pressure is smaller than at the lobe portion) is cut away by an amount according to a surface pressure imparted thereon, thereby enabling the weight of the camshaft to be reduced in an efficient manner.

In view of the above, it will be apparent to those skilled in the art from this disclosure that there exists a need for an improved camshaft and camshaft manufacturing method. This invention addresses this need in the art as well as other needs, which will become apparent to those skilled in the art from this disclosure.

SUMMARY OF THE INVENTION

With the conventional camshaft, a side surface of the cam lobe is merely cut away by an amount according to the surface pressure imparted on the cam lobe. Consequently, although the durability of the camshaft may be maintained, there is no mention of improving the durability of the camshaft in the above identified reference. Therefore, there exists a need to improve durability while reducing weight of the camshaft.

Accordingly, one objective of a camshaft and a camshaft manufacturing method is to improve the durability of the camshaft while reducing its weight.

In order to achieve the above object, a camshaft is adapted to be rotatably coupled to a shaft bearing part of an engine. The camshaft includes a cam lobe and a camshaft journal. The cam lobe has a base circle portion and a lifting lobe portion, and configured and arranged to operate one of an intake valve and an exhaust valve. The camshaft journal has a first bearing portion configured and arranged to bear a reaction force from the base circle portion of the cam lobe and a second bearing portion configured and arranged to bear a reaction force from the lifting lobe portion of the cam lobe. The first bearing portion of the camshaft journal has an axial width that is smaller than an axial width of the second bearing portion with at least a portion of an axial end surface of the first bearing portion that faces the cam lobe being disposed further away from the cam lobe with respect to an axial end surface of the second bearing portion that faces the cam lobe by a first prescribed distance. The base circle portion of the cam lobe has an axial width that is smaller than an axial width of the lifting lobe portion with at least a portion of an axial end surface of the base circle portion that faces the camshaft journal being disposed further away from the camshaft journal with respect to an axial end surface of the lifting lobe portion that faces the camshaft journal by a second prescribed distance. The cam lobe is disposed adjacent to the camshaft journal such that a minimum axial spacing between axially opposing surfaces of the cam lobe and the camshaft journal is equal to or greater than a prescribed axial spacing.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
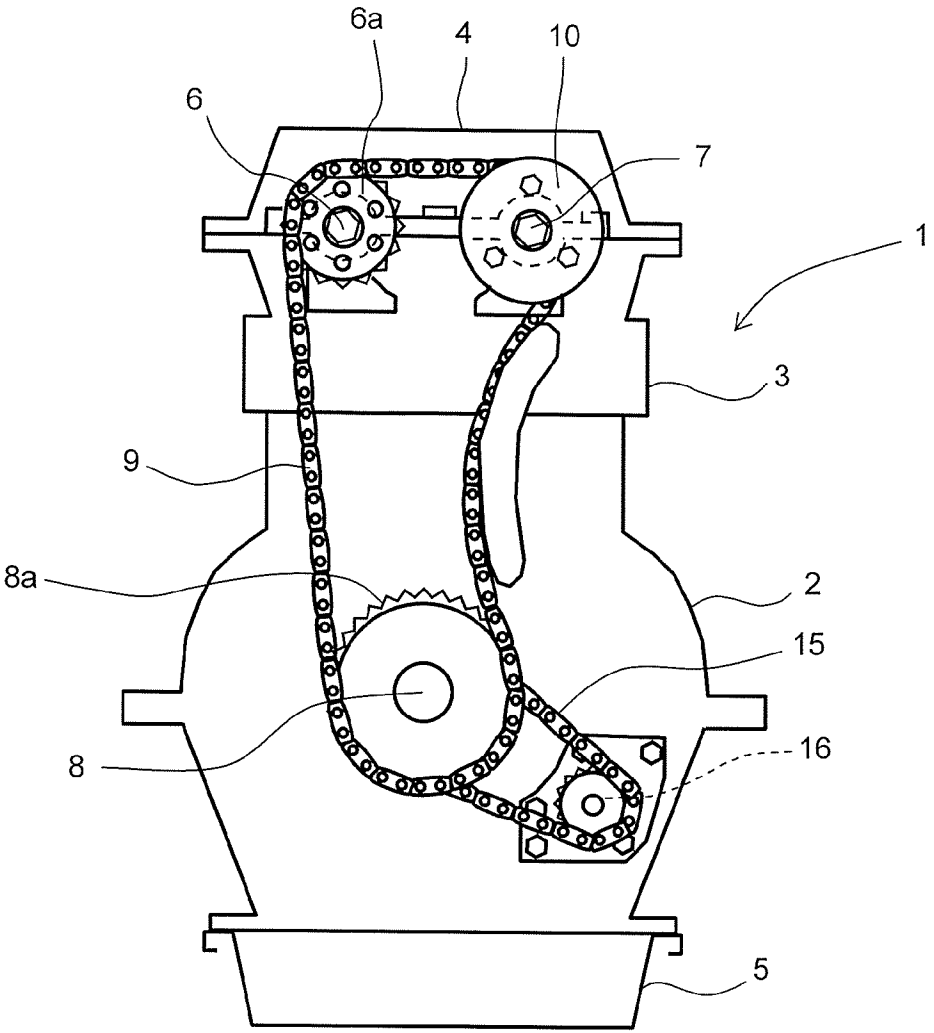
FIG. 1 is a schematic front elevational view of an engine.
Figure 2:
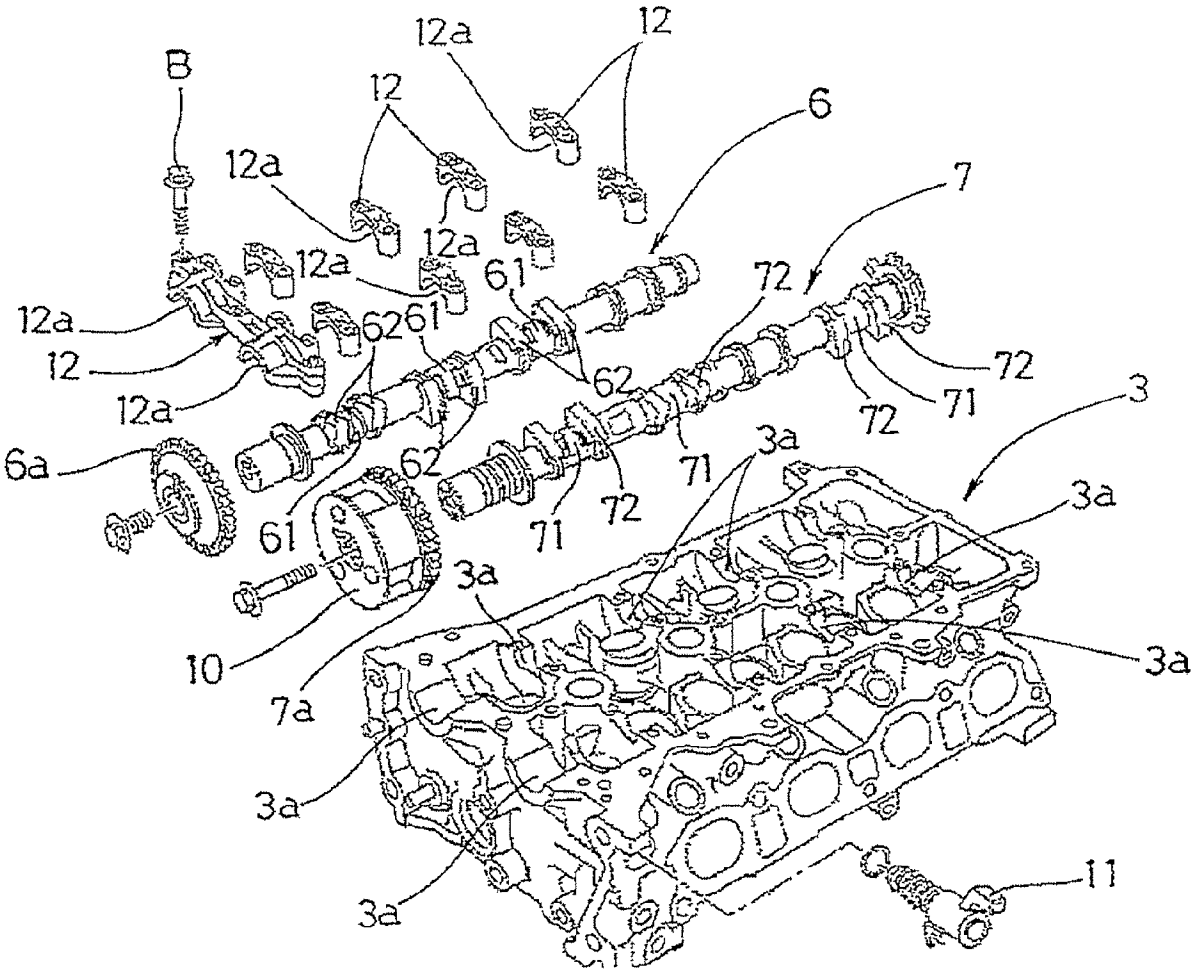
FIG. 2 is an exploded perspective view of engine components including a cylinder head, an exhaust camshaft and an intake camshaft in accordance with an illustrated embodiment of the present invention.
Figure 3:
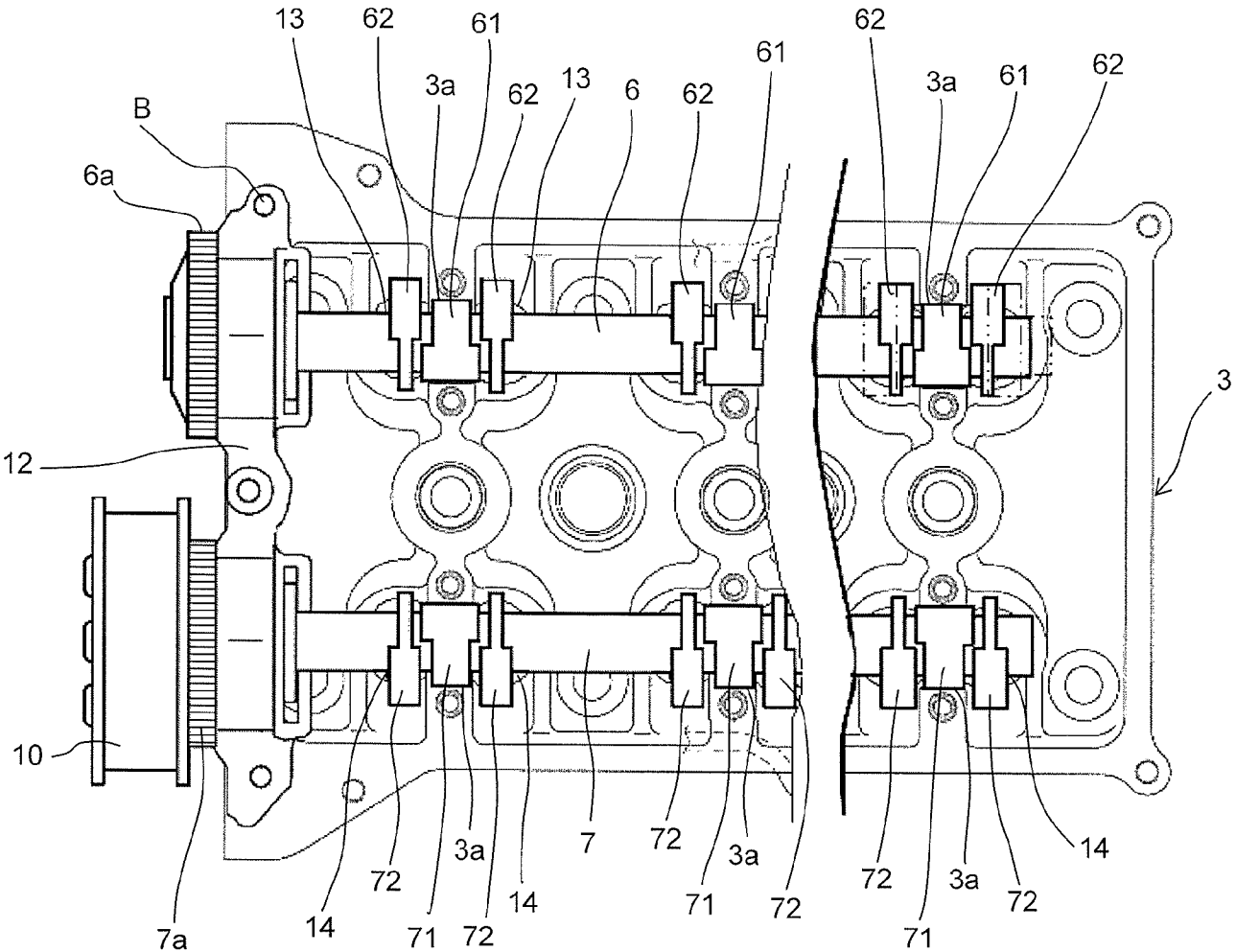
FIG. 3 is a schematic top plan view of the cylinder head with the exhaust camshaft and the intake camshaft installed therein in accordance with the illustrated embodiment of the present invention.

Referring initially to FIGS. 1 to 3, an engine 1 provided with an exhaust camshaft 6 and an intake camshaft 7 is illustrated in accordance with an illustrated embodiment. FIG. 1 is a schematic front elevational view of the engine 1. FIG. 2 is an exploded perspective view of a cylinder head 3 and the exhaust and intake camshafts 6 and 7 of the engine 1. FIG. 3 is a schematic top plan view of the cylinder head 3 with the exhaust and intake camshafts 6 and 7 installed therein.

As shown in FIG. 1, the engine 1 has a cylinder block 2 on top of which the cylinder head 3 is fastened and a cylinder head cover 4 that covers the top face of the cylinder head 3. An oil pan 5 for storing oil is provided on a bottom face of the cylinder block 2 as shown in FIG. 1.

The exhaust camshaft 6 and the intake camshaft 7 are arranged in parallel on the top side of the cylinder head 3. As shown in FIGS. 1 and 2, a cam sprocket **6*a* is attached to an axial end of the exhaust camshaft 6. Also, a cam sprocket 7*a* is attached to an axial end of the intake camshaft 7. A variable valve timing mechanism 10 is provided on the distal end of the cam sprocket 7*a* as shown in FIGS. 1 and 2**.

As shown in FIG. 1, the engine 1 also includes a crankshaft 8 that protrudes from the inside of the cylinder block 2. A crankshaft sprocket **8*a* is attached to the protruding end of the crankshaft 8. A timing chain 9 is arranged around the cam sprocket 6***a*, the cam sprocket 7*a*, and the crankshaft sprocket 8*a* as shown in FIG. 1 such that rotation of the crankshaft 8 causes the exhaust camshaft 6 and the intake camshaft 7 to be rotationally driven. As shown in FIG. 1, rotation of the crankshaft 8 also rotates an oil pump 15 by using a chain 16.

As shown in FIG. 2, the exhaust camshaft 6 and the intake camshaft 7 are rotatably arranged on a plurality of shaft bearing sections 3*a* formed in the upper surface of the cylinder head 3. A plurality of cam brackets 12 each having a shaft bearing section 12*a* is fastened to the shaft bearing sections 3*a* from above using a plurality of bolts B. The exhaust camshaft 6 includes a plurality of camshaft journals 61 rotatably supported between the shaft bearing sections 3*a* of the cylinder head 3 and the shaft bearing sections 12*a* of the cam brackets 12. Likewise, the intake camshaft 7 includes a plurality of camshaft journals 71 rotatably supported between the shaft bearing sections 3*a* of the cylinder head 3 and the shaft bearing sections 12*a* of the cam brackets 12. Thus, the shaft bearing sections 3*a* of the cylinder head 3 and the shaft bearing sections 12*a* of the cam brackets 12 collectively form a shaft bearing part of the engine 1.

A plurality of exhaust valves 13 is provided on the side of the cylinder head 3 where the exhaust camshaft 6 is arranged, and a plurality of intake valves 14 is provided on the side of the cylinder head 3 where the intake camshaft 7 is arranged.

As shown in FIGS. 2 and 3, the exhaust camshaft 6 includes a plurality of cam lobes 62 disposed on both axially facing sides of and closely adjacent to each of the camshaft journals 61 of the exhaust camshaft 6. The intake camshaft 7 includes a plurality of cam lobes 72 disposed on both axially facing sides of and closely adjacent to each of the camshaft journals 71 formed on the intake camshaft 7.

The cam lobes 62 of the exhaust camshaft 6 are configured and arranged to operate (i.e., open and close) the exhaust valves 13 as the exhaust camshaft 6 rotates. The cam lobes 72 of the intake camshaft 7 are configured and arranged to operate (i.e., open and close) the intake valves 14 as the intake camshaft 7 rotates.

Figure 4:
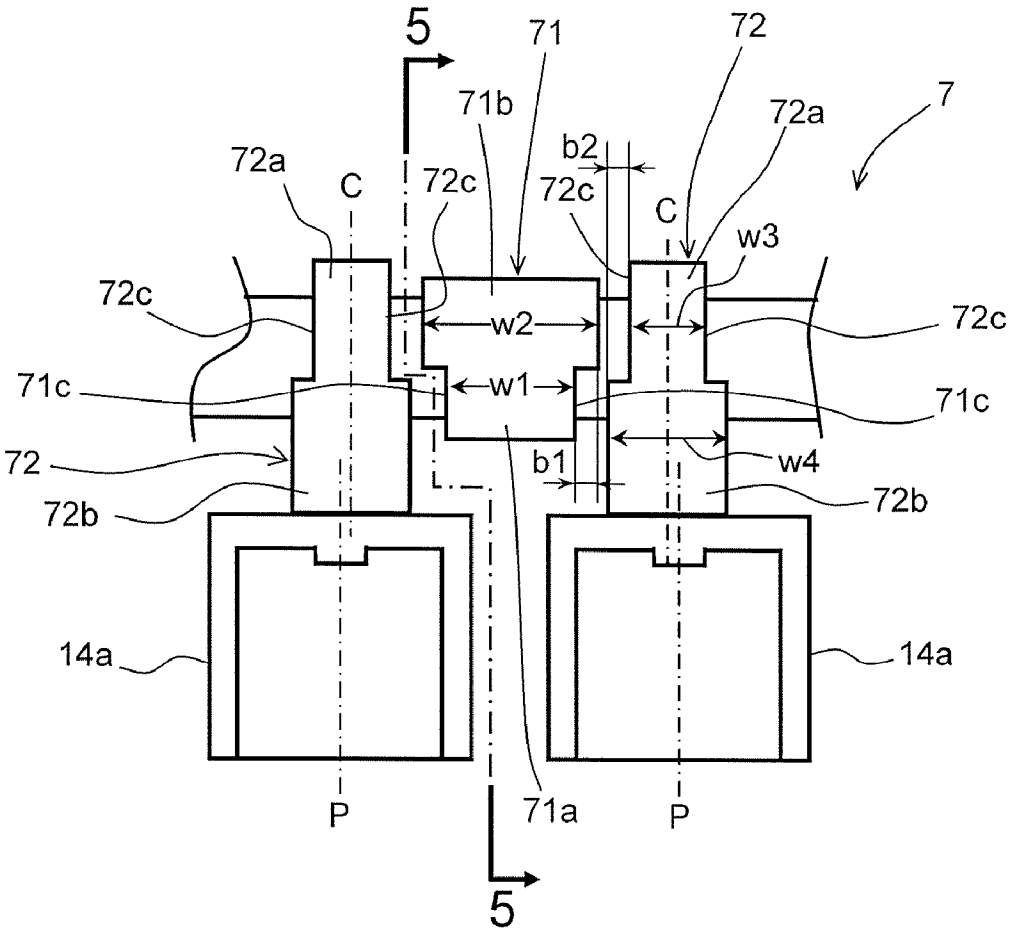
FIG. 4 is an enlarged schematic side view of constituent portions of the camshaft illustrating a relationship with respect to valve lifters in accordance with the illustrated embodiment of the present invention.
Figure 5:
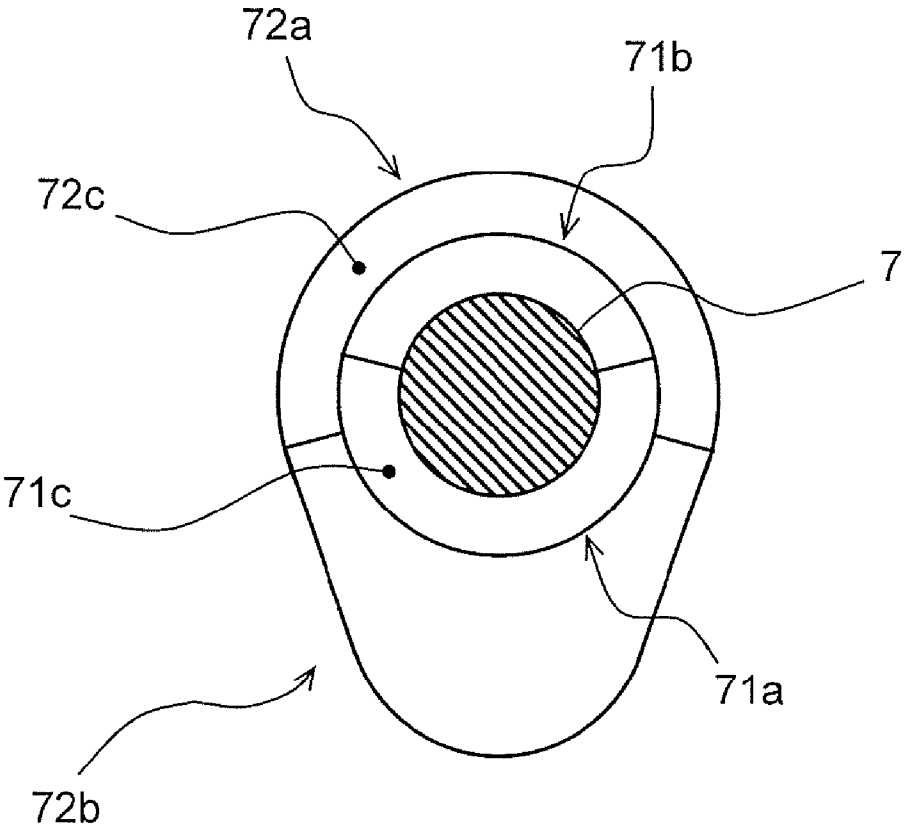
FIG. 5 is a cross sectional view of the camshaft taken along a section line 5-5 of FIG. 4 in accordance with the illustrated embodiment of the present invention.

FIG. 4 is an enlarged schematic side view of one of the camshaft journals 71 and a pair of the cam lobes 72 of the intake camshaft 7. FIG. 5 is a cross sectional view of the intake camshaft 7 as taken along a section line 5-5 in FIG. 4.

Each of the cam lobes 72 is slidably coupled to a valve lifter (lifter member) 14*a*, which is operatively coupled to one of the intake valves 14. The cam lobes 72 of the intake camshaft 7 are configured and arranged to operate the intake valves 14 by converting rotation of the intake camshaft 7 into linear motion of the lifters 14*a* of the intake valves 14. As shown in FIGS. 4 and 5, each of the cam lobes 72 has a base circle portion 72*a* and a lifting lobe portion 72*b*. The base circle portion 72*a* is configured and arranged not to operate or actuate the corresponding intake valve 14 (e.g., the intake valve is closed). The lifting lobe portion 72*b* is configured and arranged to operate or actuate the intake valve 14 (e.g., the intake valve is opened) by pushing the lifter 14*a* as the intake camshaft 7 rotates.

As shown in FIG. 4, each of the camshaft journals 71 includes a first bearing portion 71*a* and a second bearing portion 71*b*. The first bearing portion 71*a* is configured to bear a reaction force from the base circle portion 72*a* of the cam lobe 72 via the shaft bearing sections 3*a* and 12*a*. The second bearing portion 71*b* is configured and arranged to bear a reaction force from the lifting lobe portion 72*b* of the cam lobe 72 via the shaft bearing sections 3*a* and 12*a*. The reaction forces occur when the intake camshaft 7 rotates.

Each of the camshaft journals 71 is disposed on the intake camshaft 7 with respect to each of the cam lobes 72 arranged on both axially facing sides of the camshaft journal 71 so that a minimum axial spacing between axially opposing surfaces of the camshaft journal 71 and the cam lobe 72 is equal to or greater than a prescribed axial spacing. This prescribed axial spacing is determined based on casting requirements associated with cast forming the intake camshaft 7 (e.g., a requirement for removing the core sand after casting) of and performance requirements of the intake camshaft 7.

In the illustrated embodiment shown in FIG. 4, the first bearing portion 71*a* of each of the camshaft journals 71 has an axial width w1 that is smaller than an axial width w2 of the second bearing portion 71*b*. The axial width w1 in the first bearing portion 71*a* is made smaller than the axial width w2 in the second bearing portion 71*b* preferably by forming a pair of recess portions 71*c* (removed material portions) as shown in FIG. 4 (e.g., material corresponding to a first prescribed width b1 (first prescribed distance) is removed from both axially facing sides of the first bearing portion 71*a* as compared to a camshaft journal in which the recess portion 71*c* is not formed). In other words, an axial end surface of the first bearing portion 71*a* that faces the cam lobe 72 is disposed further away from the cam lobe 72 with respect to an axial end surface of the second bearing portion 71*b* that faces the cam lobe 72 by the first prescribed width b1.

On the other hand, the base circle portion 72*a* of each of the cam lobes 72 has an axial width w3 that is smaller than an axial width w4 of the lifting lobe portion 72*b*. The axial width w3 in the base circle portion 72*a* is made smaller than the axial width w4 in the lifting lobe portion 72*b* preferably by forming a pair of recess portions 72*c* (removed material portions) as shown in FIG. 4 (e.g., material corresponding to a second prescribed width b2 (second prescribed distance) is removed from both axially facing sides of the base circle portion 72*a* as compared to a conventional cam lobe in which the recess portion 72*c* is not formed). In other words, an axial end surface of the base circle portion 72*a* that faces the camshaft journal 71 is disposed further away from the camshaft journal 71 with respect to an axial end surface of the lifting lobe portion 72*b* that faces the camshaft journal 71 by the second prescribed width b2.

The first prescribed width b1 of the recess portions 71*c* of the camshaft journal 71 is set to such a dimension that a surface pressure imparted on a bearing surface of the first bearing portion 71*a* will be substantially equal to a maximum surface pressure imparted on a bearing surface of the second bearing portion 71*b*. In the illustrated embodiment, material corresponding to the first prescribed width b1 is removed uniformly in the axial and radial directions from the first bearing portion 71*a* so that axial end surfaces (bottom surfaces of the recess portions 71*c*) of the first bearing portion 71*a* extend substantially perpendicular to the center axis of the intake camshaft 7. Similarly, the second prescribed width b2 of the recess portions 72*c* of the cam lobes 72 is set to such a dimension that a surface pressure imparted on a sliding surface of the base circle portion 72*a* will be substantially equal to a maximum surface pressure imparted on a sliding surface of the lifting lobe portion 72*b*. In the illustrated embodiment, material corresponding to the second prescribed width b2 is removed uniformly in the axial and radial direction from the base circle portion 72*a* so that axial end surfaces (bottom surfaces of the recess portions 72*c*) of the base circle portion 72*a* extend substantially perpendicular to the center axis of the intake camshaft 7. The first prescribed width b1 of the recess portions 71*c* of the camshaft journal 71 and the second prescribed width b2 of the recess portions 72*c* of the cam lobe 72 can be set to the same value, or can be set to different values.

By forming the recess portions 71*c* on the first bearing portion 71*a* of the camshaft journal 71 and the recess portions 72*c* on the base circle portions 72*a* of the cam lobes 72, the cam lobes 72 on both sides of the camshaft journal 71 can each be shifted toward the camshaft journal 71 by an amount corresponding to the dimension of the removed material (the first and second prescribed widths b1 and b2). Therefore, the distance from the camshaft journal 71 to the cam lobes 72 is decreased. As a result, the bending strength, i.e., the durability, of the intake camshaft 7 can be improved.

Additionally, by removing material to the dimensions described above (e.g., the first and second prescribed widths), the weight of the camshaft 7 can be reduced without lowering the durability of the camshaft journals 71 and the cam lobes 72.

As the intake camshaft 7 rotates, the cam lobes 72 operate the intake valves 14 by pushing against the lifters 14*a*. In the illustrated embodiment, each of the cam lobes 72 is preferably arranged with respect to the corresponding lifter 14*a* such that a widthwise (axial) center C of the cam lobe 72 is closer to the camshaft journal 71 than an axial center P of the corresponding lifter 14*a* as shown in FIG. 4. In other words, a distance between the axial center C of the cam lobe 72 and the camshaft journal 71 is preferably set smaller than a distance between the axial center P of the lifter 14*a* and the camshaft journal 71. Thus, since the torque of the cam lobe 72 acts at a position offset from the axial center P of the lifter 14*a*, the lifter 14*a* can be rotated about its axial center P and uneven wearing of the lifter 14*a* can be suppressed.

Figure 6:
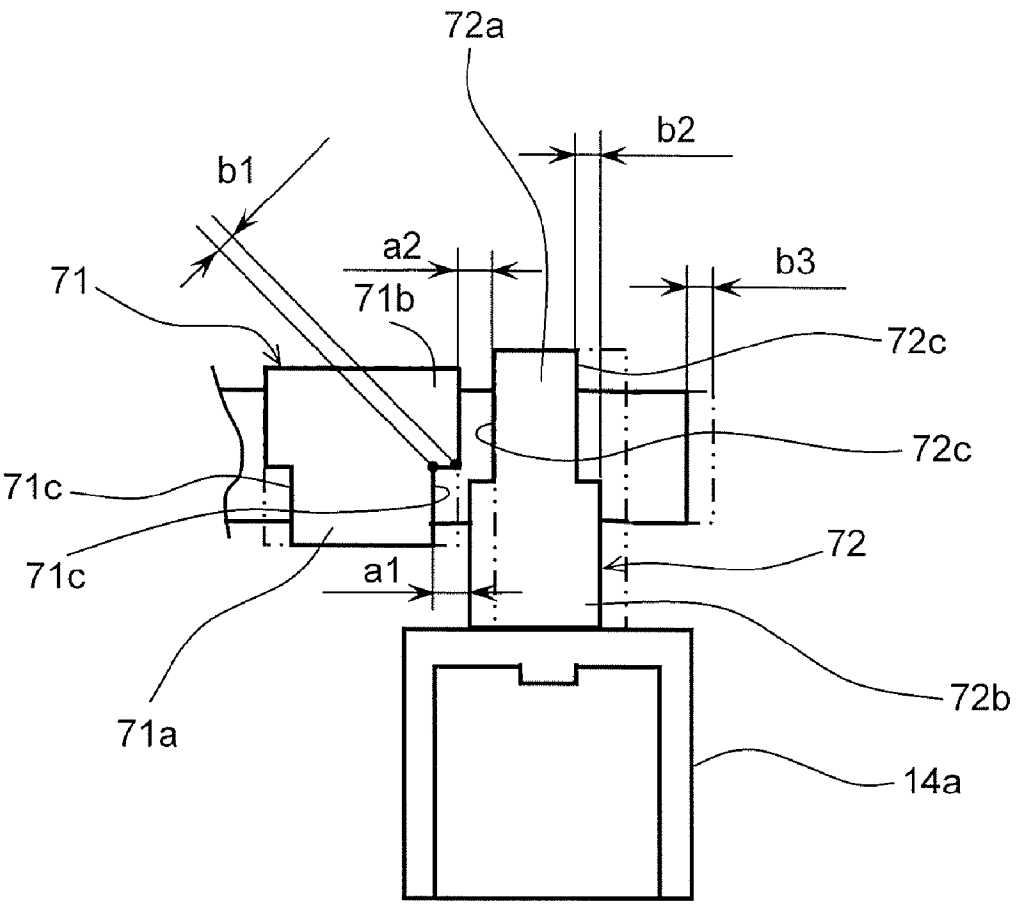
FIG. 6 is an enlarged schematic side view of the camshaft illustrating a manufacturing method of the constituent portions of the camshaft in accordance with the illustrated embodiment of the present invention.

FIG. 6 is an enlarged schematic side view of the intake camshaft 7 illustrating a manufacturing method of the constituent portions of the intake camshaft 7 in accordance with the illustrated embodiment. The portions indicated with virtual lines (long dash-dot-dot lines) show how the bearing portions would be shaped if the recess portions 71*c* and 72*c* were not formed, and the portions indicated with solid lines show how the camshaft journal 71 and the cam lobe 72 are shaped when the recess portions 71*c* and 72*c* are formed according to the illustrated embodiment.

By forming the recess portions 71*c* on the first bearing portion 71*a* of the camshaft journal 71 (e.g., removing material corresponding to the first prescribed width b1 as compared to the shape shown in the virtual lines) and forming the recess portions 72*c* on the base circle portion 72*a* of the cam lobe 72 (e.g., removing material corresponding to the second prescribed width b2 as compared to the shape shown in the virtual lines), the cam lobes 72 can each be shifted toward the corresponding camshaft journal 71 while maintaining the prescribed axial spacing. More specifically, as shown in FIG. 6, a spacing a1 is formed between axially opposing surfaces of the first bearing portion 71*a* of the camshaft journal 71 and the lifting lobe portion 72*b* of the cam lobe 72, and a spacing a2 is formed between axially opposing surfaces of the second bearing portion 71*b* of the camshaft journal 71 and the lifting lobe portion 72*a* of the cam lobe 72. The camshaft journal 71 and the cam lobe 72 are positioned with respect to each other so that the smaller one of the spacing al and the spacing a2 (i.e., a minimum axial spacing) is equal to or greater than the prescribed axial spacing, which is determined based on casting requirements associated with cast forming the intake camshaft 7 and performance requirements of the intake camshaft 7. When the camshaft journal 71 is arranged with respect to the cam lobe 72 so that the spacing a1 is equal to the spacing a2, the spacing a1 and the spacing a2 are set to be equal to or greater than the prescribed axial spacing. Therefore, a rear end portion of the intake camshaft 7 can be shortened by an amount (width b3 in FIG. 6) corresponding to a dimension by which the cam lobes 72 are shifted toward the camshaft journals 71 while the prescribed axial spacing between the camshaft journal 71 and the cam lobe 72 being ensured. As a result, the longitudinal dimension of the intake camshaft 7 can be shortened and the weight of the intake camshaft 7 can be reduced.

The prescribed spacing a shown in FIG. 6 is determined based on casting requirements associated with cast forming the intake camshaft 7 and performance requirements of the intake camshaft 7.

Although the illustrated embodiment presents an example in which the recess portions 72*c* are provided on both axially facing end surfaces of the base circle portion 72*a* of each of the cam lobes 72, it is also acceptable to provide the recess portion 72*c* only on the side that faces the camshaft journal 71. In the latter case, too, the cam lobes 72 can be shifted toward the camshaft journals 71 and a rearward end portion of the intake camshaft 7 can be shortened by an amount corresponding to the amount by which the cam lobes 72 are shifted. Therefore, the weight of the intake camshaft 7 can be reduced.

The recess portions can be formed on the exhaust camshaft 6 based on similar design conditions as the intake camshaft 7 as explained above such that the cam lobes 62 can be shifted toward the camshaft journals 61 by an amount corresponding to the dimension of the removed material in the recess portions. Therefore, the distance from the camshaft journals 61 to the corresponding cam lobes 62 can be shortened and the durability of the exhaust camshaft 6 can be improved. Additionally, a rearward end portion of the exhaust camshaft 6 can be shortened by an amount corresponding to the amount by which the cam lobes 62 are shifted toward the camshaft journals 61 such that the weight of the exhaust camshaft 6 is reduced.

Although in the illustrated embodiment described above the first prescribed width b1 of the recess portions 71*c* of the camshaft journal 71 is set to such a dimension that a surface pressure imparted on a bearing surface of the first bearing portion 71*a* will be substantially equal to a maximum surface pressure imparted on a bearing surface of the second bearing portion 71*b*, it is acceptable to set the first prescribed width b1 of the recess portions 71*c* of the camshaft journal 71 to any width so long as the surface pressure imparted on the bearing surface of the first bearing portion 71*a* will be equal to or smaller than the maximum surface pressure imparted on the bearing surface of the second bearing portion 71*b*.

Similarly, although in the illustrated embodiment described above the second prescribed width b2 of the recess portions 72*c* of the cam lobe 72 is set to such a dimension that a surface pressure imparted on a sliding surface of the base circle portion 72*a* will be substantially equal to a maximum surface pressure imparted on a sliding surface of the lifting lobe portion 72*b*, it is acceptable to set the second prescribed width b2 of the recess portions 72*c* of the cam lobe 72 to any width so long as the surface pressure imparted on the sliding surface of the base circle portion 72*a* will be equal to or smaller than the maximum surface pressure imparted on the sliding surface of the lifting lobe portion 72*b*.

Although in the illustrated embodiment described above the recess portions 71*c* of the camshaft journal 71 are formed by removing material uniformly in the axial and radial directions from the first bearing portion 71*a* of the camshaft journal 71, it is acceptable to remove material from the first bearing portion 71*a* of the camshaft journal 71 so that the axial width of the recess portion 71*c* varies (tapers) along the radial direction of the first bearing portion 71*a* so long as the surface pressure imparted on the bearing surface of the first bearing portion 71*a* will be equal to or smaller than the maximum surface pressure imparted on the bearing surface of the second bearing portion 71*b*.

Similarly, the recess portions 72*c* of the cam lobe 72 are formed by removing material uniformly in the axial and radial directions from the base circle portion 72*a* of the cam lobe 72, it is acceptable to remove material from the base circle portion 72*a* of the cam lobe 72 so that the axial width of the recess portion 72*c* varies (tapers) along the radial direction of the base circle portion 72*a* so long as the surface pressure imparted on the sliding surface of the base circle portion 72*a* will be equal to or smaller than the maximum surface pressure imparted on the sliding surface of the lifting lobe portion 72*b*.

Figure 7:
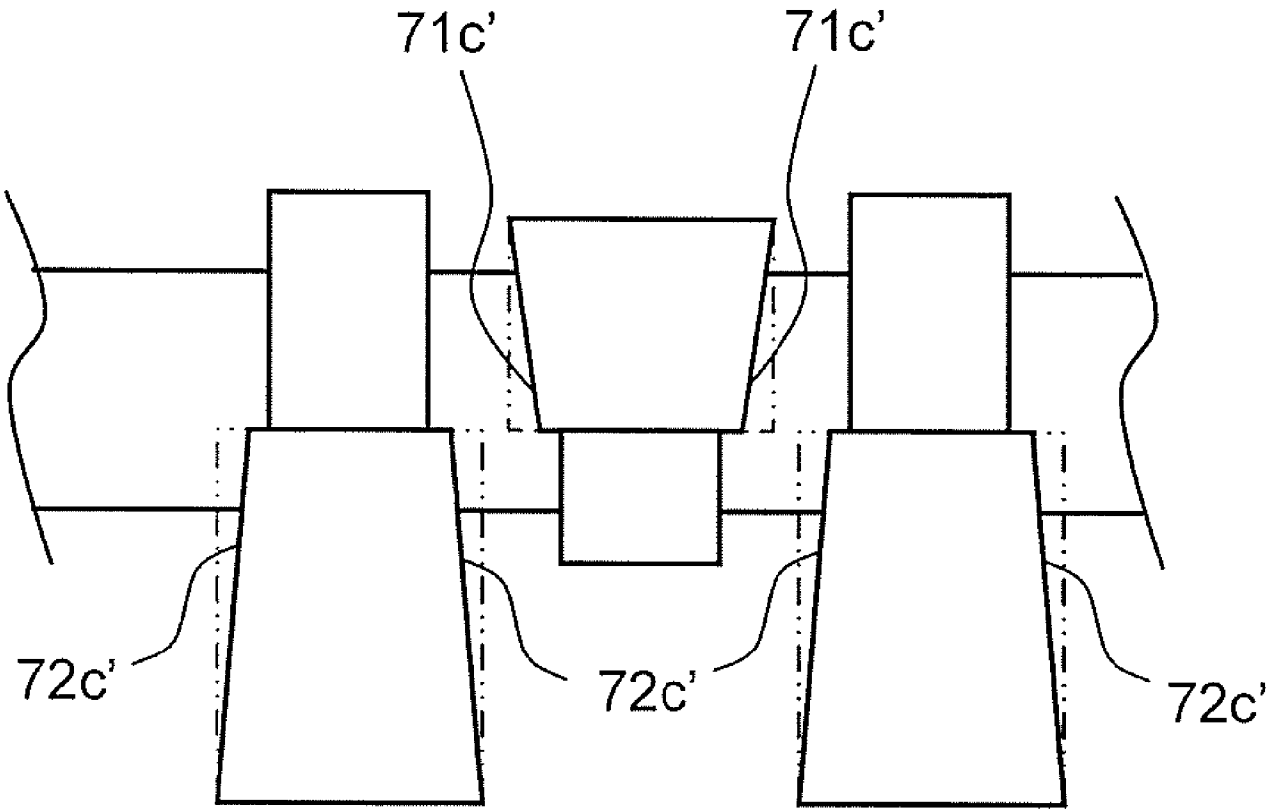
FIG. 7 is an enlarged schematic side view of constituent portions of a camshaft in accordance with a modified embodiment of the present invention.

Although in the illustrated embodiment described above the recess portions 71*c* are only provided on the first bearing portion 71*a* of each of the camshaft journals 71, it is acceptable to form the recess portion by removing material from the second bearing portion 71*b*, too, except for a portion where the maximum surface pressure occurs. For example, FIG. 7 shows a modified embodiment in which a recess (or tapered) portion 71*c*' is formed in the second bearing portion 71*b* by removing material in accordance with the surface pressure imparted on the bearing surface of the second bearing portion 71*b* such that the surface pressure does not exceed the maximum surface pressure.

Similarly, in the illustrated embodiment described above the recess portions 72*c* are only provided on the base circle portion 72*a* of each of the cam lobes 72, it is acceptable to form the recess portion by removing material from the lifting lobe portion 72*b*, too, except for a portion where the maximum surface pressure occurs. For example, FIG. 7 shows the modified embodiment in which a recess (or tapered) portion 72*c*' is formed in the lifting lobe portion 72*b* by removing material in accordance with the surface pressure imparted on the sliding surface of the lifting lobe portion 72*b* such that the surface pressure does not exceed the maximum surface pressure.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A camshaft adapted to be rotatably coupled to a shaft bearing part of an engine, the camshaft comprising:

a cam lobe having a base circle portion and a lifting lobe portion, and configured and arranged to operate one of an intake valve and an exhaust valve; and a camshaft journal having a first bearing portion configured and arranged to bear a reaction force from the base circle portion of the cam lobe and a second bearing portion configured and arranged to bear a reaction force from the lifting lobe portion of the cam lobe, an axial end surface of the first bearing portion facing an axial end surface of the lifting lobe portion of the cam lobe, and an axial end surface of the second bearing portion facing an axial end surface of the base circle portion of the cam lobe, the first bearing portion of the camshaft journal having an axial width that is smaller than an axial width of the second bearing portion with at least a portion of the axial end surface of the first bearing portion being disposed further away from the cam lobe with respect to the axial end surface of the second bearing by a first prescribed distance, and the base circle portion of the cam lobe having an axial width that is smaller than an axial width of the lifting lobe portion with at least a portion of the axial end surface of the base circle portion being disposed further away from the camshaft journal with respect to the axial end surface of the lifting lobe portion by a second prescribed distance, the cam lobe being disposed adjacent to the camshaft journal such that a minimum axial spacing between axially opposing surfaces of the cam lobe and the camshaft journal is substantially equal to a prescribed axial spacing that is a minimum allowable spacing determined based on at least one of a casting requirement associated with cast forming the camshaft and a performance requirement of the camshaft.

2. The camshaft recited in claim 1, wherein the first prescribed distance is set such that a maximum surface pressure imparted between the first bearing portion of the camshaft journal and the shaft bearing part of the engine is substantially equal to a maximum surface pressure imparted between the second bearing portion of the camshaft journal and the shaft bearing part of the engine.

3. The camshaft recited in claim 1, wherein the axial width of the second bearing portion of the camshaft journal changes in a circumferential direction according to a surface pressure imparted between the second bearing portion and the shaft bearing part of the engine so that a maximum surface pressure imparted between the second bearing portion and the shaft bearing part of the engine does not exceed a maximum surface pressure imparted between the first bearing portion and the shaft bearing part of the engine.

4. The camshaft recited in claim 1, wherein the cam lobe is configured and arranged to slidably coupled to a lifter member to operate the one of the intake valve and the exhaust valve, and the second prescribed width is set such that a maximum surface pressure imparted between the base circle portion of the cam lobe and the lifter member is substantially equal to a maximum surface pressure imparted between the lifting lobe portion of the cam lobe and the lifter member.

5. The camshaft recited claim 1, wherein the cam lobe is configured and arranged to slidably coupled to a lifter member to operate the one of the intake valve and the exhaust valve, and the axial width of the lifting lobe portion of the cam lobe changes in a circumferential direction according to a surface pressure imparted between the lifting lobe portion and the lifter member so that a maximum surface pressure imparted between the lifting lobe portion and the lifter member does not exceed a maximum surface pressure imparted between the lifting lobe portion and the lifter member.

6. The camshaft recited in claim 1, further comprising an additional cam lobe disposed adjacent to the camshaft journal on an opposite side from the cam lobe with the prescribed spacing being formed between the additional cam lobe and the camshaft journal, the additional cam lobe having a base circle portion and a lifting lobe portion, a portion of an axial end surface of the first bearing portion of the camshaft journal that faces the additional cam lobe being disposed further away from the additional cam lobe with respect to an axial end surface of the second bearing portion that faces the additional cam lobe by the first prescribed distance, and the base circle portion of the additional cam lobe having an axial width that is smaller than an axial width of the lifting lobe portion with at least a portion of an axial end surface of the base circle portion that faces the camshaft journal being disposed further away from the camshaft journal with respect to an axial end surface of the lifting lobe portion that faces the camshaft journal by the second prescribed distance.

7. A camshaft adapted to be rotatably coupled to a shaft bearing part of an engine, the camshaft comprising:

a cam lobe having a base circle portion and a lifting lobe portion, and configured and arranged to slidably coupled to a lifter member to operate one of an intake valve and an exhaust valve; and a camshaft journal having a first bearing portion configured and arranged to bear a reaction force from the base circle portion of the cam lobe and a second bearing portion configured and arranged to bear a reaction force from the lifting lobe portion of the cam lobe, the first bearing portion of the camshaft journal having an axial width that is smaller than an axial width of the second bearing portion with at least a portion of an axial end surface of the first bearing portion that faces the cam lobe being disposed further away from the cam lobe with respect to an axial end surface of the second bearing portion that faces the cam lobe by a first prescribed distance, and the base circle portion of the cam lobe having an axial width that is smaller than an axial width of the lifting lobe portion with at least a portion of an axial end surface of the base circle portion that faces the camshaft journal being disposed further away from the camshaft journal with respect to an axial end surface of the lifting lobe portion that faces the camshaft journal by a second prescribed distance, the cam lobe being disposed adjacent to the camshaft journal such that a minimum axial spacing between axially opposing surfaces of the cam lobe and the camshaft journal is equal to or greater than a prescribed axial spacing, a distance between an axial center of the cam lobe and the camshaft journal being smaller than a distance between an axial center of the lifter member and the camshaft journal.

8. A camshaft manufacturing method comprising:

providing a cam lobe having a base circle portion and a lifting lobe portion such that an axial width of the base circle portion being smaller than an axial width of the lifting lobe portion;

providing a camshaft journal having a first bearing portion that bears a reaction force from the base circle portion of the cam lobe and a second bearing portion that bears a reaction force from the lifting lobe portion of the cam lobe such that an axial width of the first bearing portion is smaller than an axial width of the second bearing portion, an axial end surface of the first bearing portion facing an axial end surface of the lifting lobe portion of the cam lobe, and an axial end surface of the second bearing portion facing an axial end surface of the base circle portion of the cam lobe;

the providing of the camshaft journal including forming a recess portion so that at least a portion of the axial end surface of the first bearing portion is disposed further away from the cam lobe with respect to the axial end surface of the second bearing portion by a first prescribed distance, the providing of the cam lobe including forming a recess portion so that at least a portion of the axial end surface of the base circle portion is disposed further away from the camshaft journal with respect to the axial end surface of the lifting lobe portion by a second prescribed distance, and the providing of the cam lobe and the camshaft including disposing the cam lobe adjacent to the camshaft journal such that a minimum axial spacing between axially opposing surfaces of the cam lobe and the camshaft journal is substantially equal to a prescribed axial spacing that is a minimum allowable spacing determined based on at least one of a casting requirement associated with cast forming the camshaft and a performance requirement of the camshaft.

9. The camshaft manufacturing method in claim 8, wherein the providing of the camshaft journal includes setting the first prescribed distance such that a maximum surface pressure imparted between the first bearing portion of the camshaft journal and a shaft bearing part of the engine slidably coupled to the camshaft journal is substantially equal to a maximum surface pressure imparted between the second bearing portion of the camshaft journal and the shaft bearing part of the engine.

10. The camshaft manufacturing method in claim 8, wherein the providing of the cam lobe includes setting the second prescribed distance such that a maximum surface pressure imparted between the base circle portion of the cam lobe and a lifter member slidably coupled to the cam lobe is substantially equal to a maximum surface pressure imparted between the lifting lobe portion of the cam lobe and the lifter member.

* * * * *